US005359751A

United States Patent [19]

Bellardini

[11] Patent Number: 5,359,751

[45] Date of Patent: Nov. 1, 1994

[54] VACUUM ATTACHMENT FOR CLEANING ELONGATE SLATS SUCH AS CEILING FAN BLADES

[76] Inventor: Tullio L. Bellardini, 57 Seminole Ave., Rockaway, N.J. 07866

[21] Appl. No.: 224,135

[22] Filed: Apr. 6, 1994

Related U.S. Application Data

[63] Continuation of Ser. No. 54,773, Apr. 27, 1993, abandoned.

[51] Int. Cl.[5] ..... A47L 9/06

[52] U.S. Cl. ..... 15/394; 15/210.1; 15/398

[58] Field of Search ..... 15/394, 398, 302, 210.1, 15/235, 160

[56] References Cited

U.S. PATENT DOCUMENTS

| | | | |
|---|---|---|---|
| D. 296,022 | 5/1988 | Restivo | D32/35 |
| D. 341,452 | 11/1993 | Songer | D32/33 |
| 2,178,849 | 11/1939 | Breuer | 15/394 |
| 2,207,320 | 7/1940 | Jones . | |
| 2,277,444 | 3/1942 | McPhee | 15/394 |
| 2,396,862 | 3/1946 | Linderoth | 15/398 |
| 2,558,253 | 6/1951 | Ines | 15/394 |
| 2,652,583 | 9/1953 | Tomanica | 15/394 |
| 2,804,640 | 9/1957 | Zaidan | 15/394 |
| 3,110,923 | 11/1963 | Berleme | 15/394 |
| 3,520,018 | 7/1970 | Zaidan | 15/394 |
| 4,591,390 | 5/1986 | Scott et al. | 15/302 |
| 4,787,118 | 11/1988 | Weiland et al. | 15/394 |
| 4,823,431 | 4/1989 | Carpenter | 15/394 |
| 4,827,556 | 5/1989 | Corsetti | 15/244.1 |
| 4,841,592 | 6/1989 | Restivo | 15/210.1 |
| 5,116,151 | 5/1992 | Lytton et al. | 401/9 |
| 5,235,722 | 8/1993 | Harris et al. | 15/394 |
| 5,313,687 | 5/1994 | Schneider | 15/394 |

FOREIGN PATENT DOCUMENTS

| | | | |
|---|---|---|---|
| 160686 | 1/1955 | Australia | 15/394 |
| 488397 | 7/1938 | United Kingdom | 15/398 |

*Primary Examiner*—David A. Scherbel
*Assistant Examiner*—Patrick F. Brinson
*Attorney, Agent, or Firm*—Lerner, David, Littenberg, Krumholz & Mentlik

[57] ABSTRACT

A vacuum cleaner attachment for cleaning elongate slats such as ceiling fan blades is disclosed. The vacuum cleaner attachment comprises a housing adapted to receive at least one of the slats. A brush device is arranged in the housing for brushing particulate matter off of at least one of the slats, a pivotable connection device is arranged between the housing and a vacuum cleaner for providing the vacuum cleaner attachment with a relatively large degree movement when used in cleaning operations. Additionally, a sealing device for concentrating a flow of air generated by the vacuum cleaner is arranged within the housing and is adapted to permit at least one slat to extend therethrough while at least partially closing off one side of the housing.

4 Claims, 3 Drawing Sheets

VACUUM ATTACHMENT FOR CLEANING ELONGATE SLATS SUCH AS CEILING FAN BLADES

This is a continuation of U.S. patent application Ser. No. 08/054,773 filed Apr. 27, 1993 now abandoned.

FIELD OF THE INVENTION

The present invention relates to the field of vacuum cleaner attachments. More particularly, the present invention relates to a vacuum cleaner attachment for cleaning elongate slats such as ceiling fan blades.

BACKGROUND OF THE INVENTION

It is often desirable to clean the blades of ceiling fans so that unsightly dust does not accumulate on the same. However, it has heretofore been a problem to efficiently and effectively clean such ceiling fan blades. This is so because dust has a tendency to quickly accumulate on the large surface area of fan blades and because prior art cleaning aids have been generally ineffective at removing such dust therefrom.

Thus, in the past, if a person desired to adequately remove dust which has settled upon ceiling fan blades, he or she would have to clean each individual fan blade by hand, usually while standing on a ladder, by using a damp dust cloth or the like. The ladder would have to be moved after cleaning a relatively small area to assure that too much pressure was not exerted on the fan blades, or to assure that dust was not merely being pushed off of an associated fan blade and onto other objects. Cleaning ceiling fan blades in the past was therefore a tedious task.

Accordingly, there is a great need for a cleaning aid for cleaning elongate slats such as ceiling fan blades, which will permit a person to efficiently and effectively remove dust which has accumulated on a ceiling fan blade without agitating such dust so as to create airborne dust particles which would be inhaled by individuals in the immediate area, or would otherwise settle on undesirable places. Additionally, an effective cleaning aid should also have a large degree of flexibility and pivotability so that the delicate balance of a ceiling fan is not disturbed during the cleaning process.

The prior art has not provided any solution to the problem of cleaning ceiling fan blades without disturbing the balance of the ceiling fan. Additionally, the prior art has not provided a vacuum cleaner attachment for effectively and efficiently cleaning ceiling fan blades. One prior art device which utilizes a vacuum cleaner in connection with a ceiling fan blade cleaner, is disclosed in U.S. Pat. No. 4,823,431 to Carpenter. However, the Carpenter device has several major drawbacks. In particular, the Carpenter device has an entirely rigid construction and thus, it requires a great deal of movement by the user relative to a fan blade, which is being cleaned, to assure that the excessive pressure will not be exerted on the fan blade thus disturbing the balance of the entire ceiling fan. Additionally, the air flow generated by the vacuum cleaner associated with the Carpenter device is inefficiently applied to a ceiling fan blade to be cleaned. This is so because the Carpenter device does not include an air flow facilitation means, such as a flap, which concentrates the air flow on an associated fan blade. Thus, the fan blade cleaning device of Carpenter will not efficiently remove dust and other particulate matter from ceiling fan blades.

Accordingly, there has been a considerable need for an improved cleaning aid, such as the present vacuum cleaner attachment for cleaning elongate slats which will facilitate the quick and effective removal of particulate matter from the surface of ceiling fan blades without the risk of disturbing the balance of an associated ceiling fan.

It is thus evident from all the drawbacks of prior art cleaning aids, including the Carpenter device, that there is a considerable need for a new and improved vacuum cleaner attachment for cleaning elongate slats such as ceiling fan blades. The present invention solves all of the aforementioned problems and will greatly benefit all individuals who will undertake the task of cleaning ceiling fan blades.

SUMMARY AND OBJECTS OF THE INVENTION

One aspect of the present invention pertains to a vacuum cleaner attachment for cleaning elongate slats such as ceiling fan blades. The vacuum cleaner attachment comprises a housing adapted to receive at least one of the elongate slats therein. Brush means are arranged in the housing for brushing particulate matter off of a fan blade received within the housing. The present invention also includes connection means for pivotally connecting the housing to a vacuum cleaner, whereby the housing can be manipulated to receive said at least one slat without applying a large amount of force thereto and whereby the particulate matter can be sucked into the vacuum cleaner during cleaning of an associated fan blade. The pivotal connection between the present cleaning device and an associated vacuum cleaner helps assure that a ceiling fan will not be thrown out of balance while particulate matter is being removed from the fan blades thereof.

In a preferred embodiment, the connection means may comprise a flexible hose; however, it may also comprise a device including a pivot joint such as a ball-bearing device or a swivel device.

In another preferred embodiment, the housing of the present vacuum cleaner attachment includes a receiving side for receiving at least one fan blade therein and an exit side for permitting the same fan blade to emerge therefrom. Brush means is also included in this embodiment; however, the connection means need not pivotally connect the housing to an associated vacuum cleaner, but instead may comprise a fixed connection. The vacuum cleaner attachment of this embodiment also includes sealing means for concentrating a flow of air generated by the associated vacuum cleaner within the housing. The sealing means are adapted to permit the ceiling fan blade received within the housing to extend therethrough while at least partially closing the exit side of the housing with respect to the outside environment. Preferably, however, the connection means are pivotally arranged between the housing and an associated vacuum cleaner.

In still another preferred embodiment, the housing includes an elongate top panel and an elongate bottom panel. Each of the panels define a width including a distance sufficient to receive an associated ceiling fan blade therein. Each of the panels also define an elongate length adapted to extend a predetermined distance along the associated ceiling fan blade to be cleaned, wherein the predetermined distance corresponds to a distance at least substantially as great as that of the width. In another preferred embodiment, the elongate length may define a distance greater than the distance of the width.

Accordingly, it is an object of the present invention to provide a vacuum cleaner attachment for cleaning elongate slats such as ceiling fan blades, wherein the ceiling fan will not be thrown out of balance during cleaning of the blades thereof.

It is another object of the present invention to provide a vacuum cleaner attachment wherein air flow created by the vacuum cleaner will be concentrated within a housing to effectively remove particulate matter from associated fan blades.

It is another object of the present invention to provide a vacuum cleaner attachment having sealing means, such as a flexible flap arranged adjacent an exit side of the housing wherein the flexible flap substantially blocks air from entering or leaving the exit side during cleaning of an associated fan blade.

It is still another object of the present invention to provide a vacuum cleaner attachment having an elongate housing so that particulate matter can efficiently and effectively be removed from ceiling fan blades.

It is yet another object of the present invention to provide a vacuum cleaner attachment which will eliminate the need to constantly move a ladder which is being used to clean ceiling fan blades.

These and other objects of the present invention will be more clearly understood when read in conjunction with the detailed description and the accompanying drawings which follow.

DETAILED DESCRIPTION OF THE PREFERRED EMBODIMENTS

Figure 1:
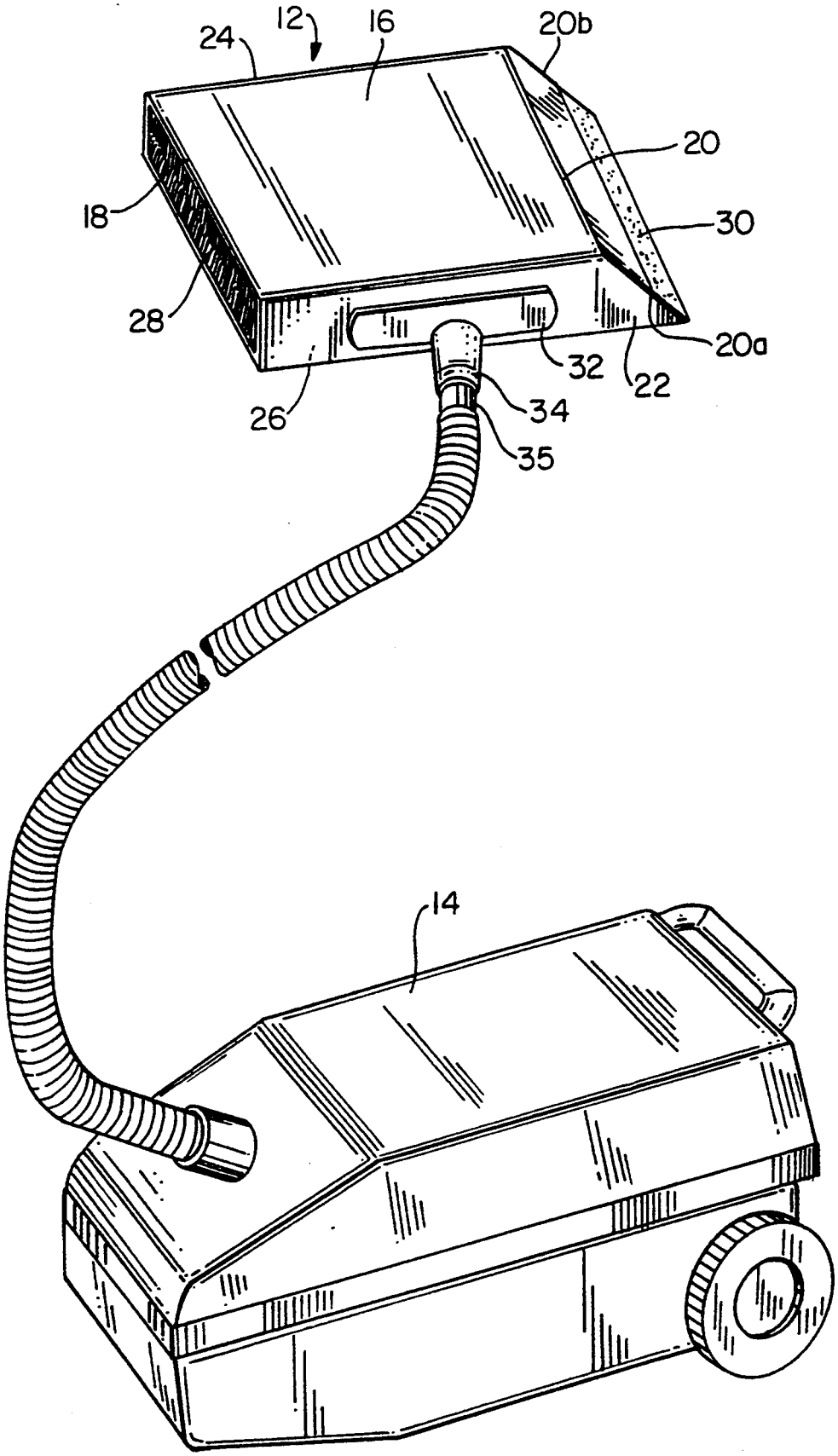
FIG. 1 is a perspective view of the vacuum cleaner attachment of the present invention in assembled position on an associated vacuum cleaner.
Figure 2:
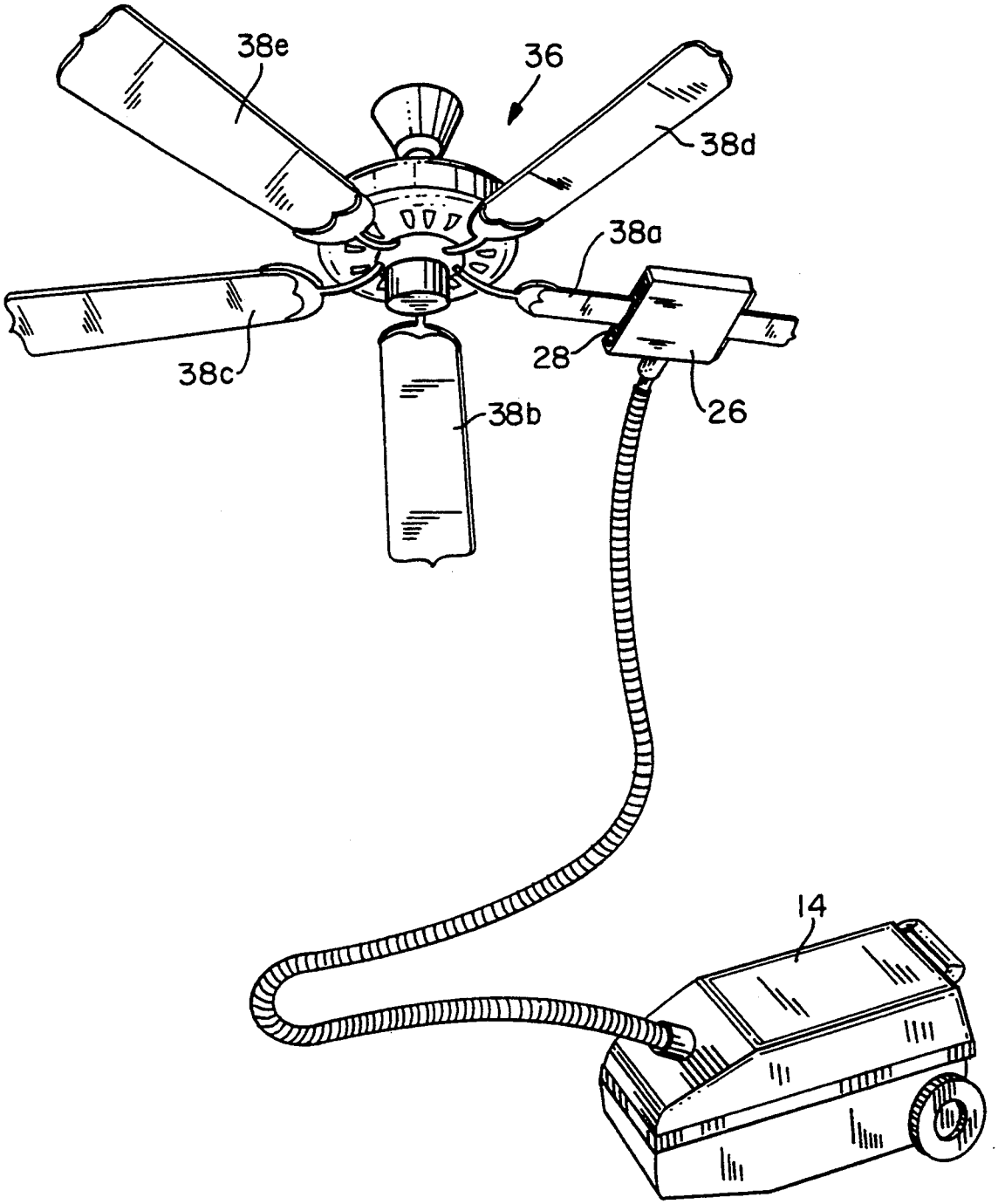
FIG. 2 is a perspective view of the vacuum cleaner attachment shown in FIG. 1 in use on an associated ceiling fan blade.

A vacuum cleaner attachment for cleaning ceiling fans blades is generally designated 10 in accordance with one preferred embodiment of the present invention. As shown in FIGS. 1 and 2, the vacuum cleaner attachment 10 is adapted for use in connection with a vacuum cleaner 14 for cleaning elongate slats such as ceiling fan blades 38*a*–38*d*. The present invention may be used to clean many types of elongate slats besides ceiling fan blades; thus, one skilled in the art would readily appreciate that while cleaning of ceiling fan blades will be described throughout this application, such fan blades represent any elongate slat having a structure sufficiently adapted to be cleaned by the vacuum cleaner attachment 10 of the present invention.

In FIGS. 1 and 2, the vacuum cleaner attachment 10 is disclosed as comprising an elongate housing 12. The elongate housing 12 includes a top side 16 and a bottom side 26 which collectively define a predetermined height therebetween as determined by opposing sidewalls 22 and 24. The elongate housing 12 also includes a front side 18 and a rear side 20. As will be discussed in more detail below, the elongate housing 12 is sufficiently sized and shaped to accommodate one of the ceiling fan blades 38*a*–38*d* therein during cleaning of such fan blade.

In a preferred embodiment, the vacuum cleaner attachment 10 may include a brush 28 arranged adjacent the front side 18. One skilled in the art would, however, appreciate that the location of the brush 28 may be moved to any location within the housing 12. Of course, it is preferable for the brush 28 to be arranged on the front side 18 of the housing 12; upstream from the airflow connector 32. Such arrangement will be better understood when the operation of the vacuum cleaner attachment 10 is discussed below.

The brush 28 comprises a plurality of bristles made of a relatively soft material so that such bristles do not scratch the surface of fan blades 38*a*–38*d* when removing particulate matter therefrom. Most preferably, the bristles are arranged to extend downwardly from the top panel 16 of the housing 12 and upwardly from the bottom panel 26. Thus, in this preferred embodiment, the brush 28 will effectively contact both planar surfaces of an associated fan blade 38*a*–38*d*. In an alternate embodiment (not shown) the brush 28 may comprise cloth-like material instead of bristles.

Figure 3:
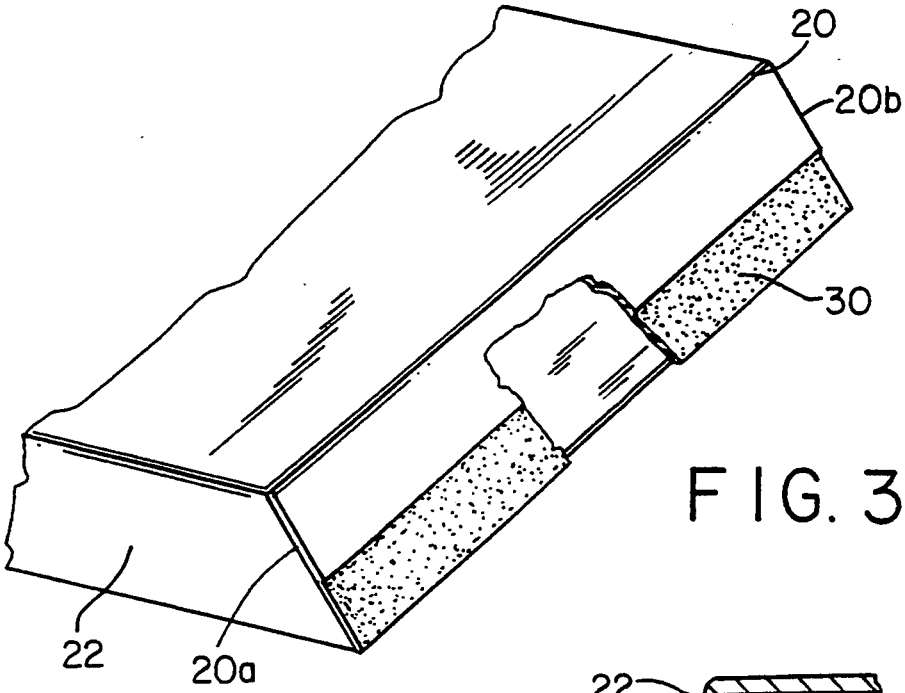
FIG. 3 is a perspective cut away rear view of the present invention.

A flexible flap 30 is preferably manufactured of a polyethylene or rubber based material and is arranged at the rear side 20 of the housing 12. As best shown in FIGS. 1 and 3, the rear side 20 may have beveled edges 20*a* and 20*b*. Of course, the edges 20*a* and 20*b* need not be beveled but may be perpendicular, as are the edges on the front side 18. In the preferred embodiment of the present invention, the flexible flap 30 is fixed to the bottom 26 of the housing 12 at the rear side 20 thereof. It extends upwardly toward the top 16 and may completely seal the rear side 20, i.e., the exit side, of the housing 12 from communication with the outside environment. However, the flexible flap 30 is not attached to the top side 16 of the housing 12 but, instead, merely lies in contact against the top 16 so that the housing 12 only appears to be sealed at the rear side 20 when not in use. The flexible nature of the flap 30 permits a respective one of the ceiling fan blades 38*a*–38*b* to force the flap 30 away from the top 16 during cleaning of such fan blade.

As the function of the flexible flap 30 serves to increase the concentration of airflow within the housing 12, it should be understood that additional embodiments of the vacuum cleaner attachment 10 may include a pair of flexible flaps similar to flexible flap 30; each of such flaps being arranged adjacent the front side 18 and the rear side 20 of the housing 12, respectively. Such an embodiment would further increase the concentration of the airflow within the housing 12. In another embodiment of the present invention (not shown) the flexible flap 30 may be fixed to both the top 16 and the bottom 26 of the housing 12, but includes a central cut-out portion therein to permit an associated fan blade to extend therethrough.

In still another preferred embodiment (not shown) the flap 30 may be constructed of a rigid material. In this embodiment, the flap 30 does not extend entirely across the opening of the rear side 20. Instead, the flap 30 is sized and shaped to retain a small gap between the top 16 and the bottom 26 of the housing 12 so that an associated ceiling fan blade 38*a*–38*d* 38*d* can extend therethrough.

Figure 4:
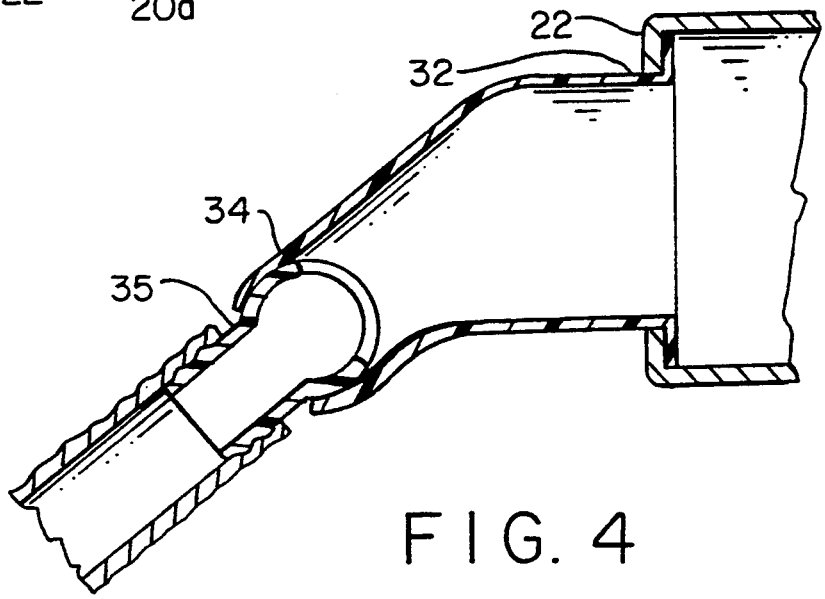
FIG. 4 is a cut away front view of the present invention.

An air flow connector 32 is fixed to the housing 12 and is adapted to connect the same to an associated vacuum cleaner 14. The air flow connector 32 must therefore define a passageway therein between the inside of the housing 12 and the hose of the vacuum cleaner 14. In FIGS. 1 and 4, the air flow connector 32 has a generally elongate oval shape and is fixed on the side wall 22 of the housing 12. A pivot joint 34 is arranged on the air flow connector 32 for permitting the vacuum cleaner attachment 10 to have a large degree of movement during cleaning operations.

Figure 5:
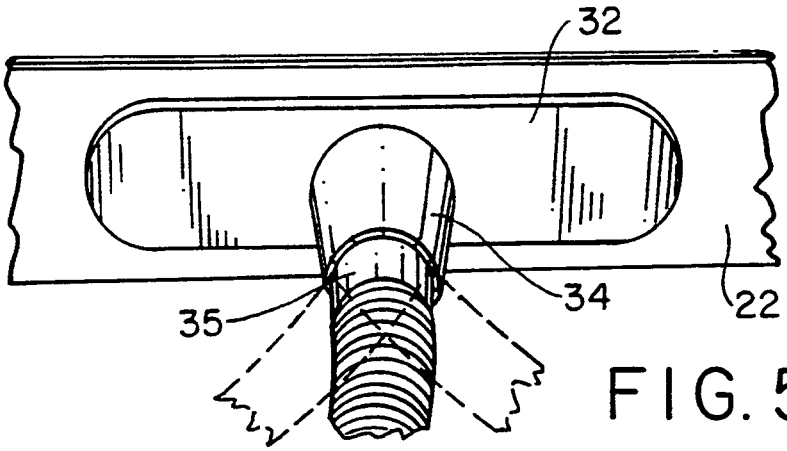
FIG. 5 is a detailed side perspective view showing the pivotable feature of the present invention.

As can be appreciated with reference to FIGS. 4 and 5, the pivot joint 34 may include a ball-bearing device, a swivel device, a slide-bearing device or the like. The pivot joint 34 also has an air flow connector tube 35 attached thereto for connection to a hose of an associated vacuum cleaner 14. Of course, if the vacuum cleaner includes a rigid tubular member connected to the hose, the air flow connector tube 35 will be adapted to become engaged with such rigid member instead of the hose itself. As shown by the dotted lines in FIG. 4, the pivot joint 34 permits the housing 12 to have a large degree of movement with respect to the associated air flow connector tube 35. Such movement minimizes the stress exerted on a ceiling fan 36 when the fan blades **38*a*–38*d* are being cleaned and is thus one advantageous feature of the present invention over the prior art cleaning devices. Alternatively, the pivot joint 34 may be replaced by a flexible hose (not shown). The flexible hose should have a sufficient degree of flexibility to permit the housing 12 to easily "pivot", or move, with respect to the hose of the associated vacuum cleaner 14. The pivotability, i.e., flexibility, feature of the present vacuum cleaner attachment 10** will be best understood in connection with the operation of the same as described below.

The vacuum cleaner attachment 10 is used to remove particulate matter, such as dust, which may accumulate on the relatively large surface areas of associated fan blades **38*a*–38*d* of the ceiling fan 36 as shown in FIG. 2. Thus, in operation, the elongate housing 12 is arranged on an associated ceiling fan blade 38*a*** so that it may slide end-to-end thereon.

As discussed above, the housing 12 has a sized and shaped front side 18, i.e., a receiving side, and a rear side 20, i.e., an exit side, aligned along a common plane therewith. The front side 18 is adapted to receive an end of the ceiling fan blade **38*a* therein while the rear side 20 is adapted to permit the same end of the ceiling fan blade 38*a* to emerge therefrom after dust particles have been removed from the fan blade. More particularly, when a first end of the ceiling fan blade 38*a* is received by the front side 18 of the housing 12, the brush 28 agitates dust particles which may have settled on the surface. When the vacuum cleaner 14 is placed in an on position it generates an air flow sufficient to suck the dust particles, which have been agitated by the brush 28, through the air flow connector 32, the pivot joint 34, the airflow connector tube 35 and into a storage tank thereof. As the fan blade 38*a* extends coplaner with the top side 16 and the bottom side 26 of the housing 12, it eventually encounters a flexible flap 30 at the rear side 20 of the housing 12. As discussed above, the flap 30 is adapted to permit the fan blade 38*a* to extend therethrough so that the vacuum cleaner attachment 10 can slide along the entire length of the fan blade 38*a***.

Preferably, the flexible flap 30 retains a substantially closed configuration between the inside of the housing 12 and the outside environment so that the airflow concentration generated by the vacuum cleaner 14 can be maximized within the housing 12. Thus, as the vacuum cleaner attachment 10 slides along the length of the fan blade **38*a*, it effectively and efficiently removes particulate matter thereon by agitating the same with the brush 18 and sucking such particulate matter into the associated vacuum cleaner 14. By cleaning fan blades 38*a*–38*d*** in this manner, little or no dust will accidently be brushed from the surface of the fan blades onto the floor.

The pivot joint 34 is particularly useful during the cleaning process. More specifically, it permits the housing 12 to slide along an associated fan blade while placing a minimal amount of stress upon such fan blade. This is desirable when the fan blades are connected to a ceiling fan. In this regard, those familiar with ceiling fans can appreciate that most ceiling fans are relatively difficult to balance. Once they are balanced, they can easily be thrown out of balance by placing too much pressure on one of the fan blades. Thus, it is particularly desirable for a cleaning aid to place a minimal amount of stress on the fan blades while cleaning the same. This result is achieved by the pivot joint 34, which permits a user to clean particulate matter from ceiling fan blades while exerting a minimal amount of pressure upon the same. No known prior art device for cleaning ceiling fan blades includes pivot means, such as pivot joint 34, to reduce the stress exerted upon the fan blades during cleaning operations. Thus, in order to avoid disturbing the delicate balance of associated ceiling fan while using prior art devices to clean the fan blades, it is usually necessary for the person performing the cleaning operation to move along the entire length of each of the blades while cleaning the same. If such precaution is not followed, a large amount of stress will be transferred from the cleaning device to the fan blade and thus, the balance of the ceiling fan will be disturbed.

While the foregoing description and figures are directed toward the preferred embodiments in accordance with the present invention, it should be appreciated that numerous modifications can be made to each of the components of the vacuum cleaner attachment 10 as discussed above. Indeed, such modifications are encouraged to be made in the materials, structure and arrangement of the disclosed embodiments of the present invention without departing from the spirit and the scope of the same. Thus, the foregoing description of the preferred embodiments should be taken by way of illustration rather than by way of limitation with respect to the present invention as defined by the claims set forth below.

What is claimed is:

1. A vacuum cleaner attachment for cleaning elongate slats such as ceiling fan blades comprising:

a housing adapted to receive at least one of the slats therein, said housing having:

(a) an elongate top panel and an elongate bottom panel defining a predetermined height therebetween as determined by opposing first and second side walls, wherein said top and bottom panels define a width of a distance sufficient to receive said at least one slat therein, and an elongate length adapted to extend a predetermined distance along said at least one slat corresponding to a distance at least as substantially great as that of said width; and (b) a receiving side for receiving said at least one slat therein and an exit side for permitting emergence of said at least one slat therefrom, wherein said opposing first and second side walls define the distance between said receiving side and said exit side;

flexible flap means for sealing said exit side of said housing and concentrating the flow of air generated by the vacuum cleaner within said housing, said flap means being adapted to permit the at least one slat to extend therethrough and to at least partially close said exit side of said housing with the at least one slat extending therethrough, so that the concentrated flow of air within said housing facilitates the sucking up of particulate matter into said vacuum cleaner; and means for pivotally connecting said housing to a vacuum cleaner at said first or second side wall, thereby maintaining said housing coplanar with said slat in the plane of rotation of said ceiling fan blade, so that the elongate slats are less likely to become imbalanced or otherwise damaged as a result of cleaning the same with the attachment, whereby said housing can be manipulated to receive the at least one slat and particulate matter can be sucked into a vacuum cleaner during cleaning of the at least one slat.

2. The vacuum cleaner attachment of claim 1, further comprising means arranged in said housing for brushing particulate matter off of the at least one slat.

3. The vacuum cleaner attachment of claim 2, wherein said brush means is arranged adjacent said receiving side of said housing.

4. The vacuum cleaner attachment of claim 1, wherein said elongate length defines a distance greater than said distance of said width.

* * * * *